United States Patent [19]

Raymond

[11] Patent Number: 5,042,417

[45] Date of Patent: Aug. 27, 1991

[54] BOAT LIFT

[75] Inventor: James W. Raymond, Duluth, Minn.

[73] Assignee: Liftmate, Inc., Duluth, Minn.

[21] Appl. No.: 422,622

[22] Filed: Oct. 17, 1989

[51] Int. Cl.[5] ..... B63B 21/00

[52] U.S. Cl. ..... 114/343; 114/344; 440/36

[58] Field of Search ..... 114/44, 343, 344, 230; 405/3, 203; 440/36

[56] References Cited

U.S. PATENT DOCUMENTS

| | | | |
|---|---|---|---|
| 2,795,432 | 6/1957 | Martt | 280/44 |
| 2,969,885 | 1/1961 | Lutz | 214/500 |
| 3,158,881 | 12/1964 | Clausen | 114/344 |
| 3,295,864 | 1/1967 | Norrby | 280/414 |
| 3,300,796 | 1/1967 | Powers | 114/344 |
| 3,436,773 | 4/1969 | Richardson | 114/344 |
| 3,462,781 | 8/1969 | Olvera | 114/344 |
| 3,589,748 | 6/1971 | Miller | 280/150.5 |
| 3,881,691 | 5/1975 | Colclasure | 254/94 |
| 3,997,191 | 12/1976 | Morgan | 280/763 |
| 4,146,250 | 3/1979 | DenHerder | 280/765 |
| 4,318,632 | 3/1982 | Fortmeyer | 405/3 |
| 4,536,009 | 8/1985 | Ashworth | 280/755 |
| 4,567,844 | 2/1986 | Johnson | 114/344 |

*Primary Examiner*—Sherman Basinger
*Attorney, Agent, or Firm*—Kinney & Lange

[57] ABSTRACT

An attachment for a boat which raises at least the stern of a boat for transportation and/or storage. A stern support, a pivot for securing the support to the boat, and a system for pivoting the support are disclosed. The support pivoting system rotates the support from an initial position to a final position whereby the boat is sufficiently elevated relative to the ground or water bottom.

26 Claims, 2 Drawing Sheets

BOAT LIFT

BACKGROUND OF THE INVENTION

1. Field of the Invention

The present invention relates to a boat lift and, particularly, to an attachment for a boat for raising at least the stern of the boat by engagement with the ground or water bottom.

2. Description of the Prior Art

When a boat is not in use, and particularly when it is out-of-use for long periods of time, it is desirable that the boat be elevated relative to the water line to reduce the interaction between the boat and water and, perhaps, to prevent damage to the boat due to waves, for example. In other instances, it may be useful or desirable that the boat be raised in preparation for transport or storage. To this end, various raising arrangements have been made for storing a boat above the water. These prior types of arrangements, however, often involve trailers and trailer accessories which are specially designed to provide the desired lifting action or require stationary supporting structures capable of bearing the weight of the boat. Thus, these alternatives are inconvenient and often very expensive.

There is a continuing need for an improved, portable boat lift. Ideally, such a lift should be designed in such a manner that assembly can be made by the average boat owner. The boat lift should be sturdy and, of course, be relatively easy and inexpensive to manufacture to be commercially viable.

SUMMARY OF THE INVENTION

The present invention provides an attachment which, when affixed to a boat, is capable of lifting the stern of the boat relative to the ground or water bottom. The stern may be raised to facilitate transportation of the boat or for storage of the boat in a steady, elevated position relatively unaffected by marine disturbances, all in an uncomplicated and efficient fashion.

The above is accomplished by a boat support pivotally attached at the boat stern and means for pivoting the support from an initial position to a final position wherein the boat is elevated with respect to the ground or water bottom. In a preferred embodiment the means for pivoting the support includes a winch attached to the bow of the boat with a plurality of flexible tension members extending between the winch and the support. The winch may be secured to a frame supported along the boat gunwales. When the winch is driven, the support is pivoted from its initial position until the boat is satisfactorily raised.

DETAILED DESCRIPTION OF THE PREFERRED EMBODIMENTS

Figure 1:
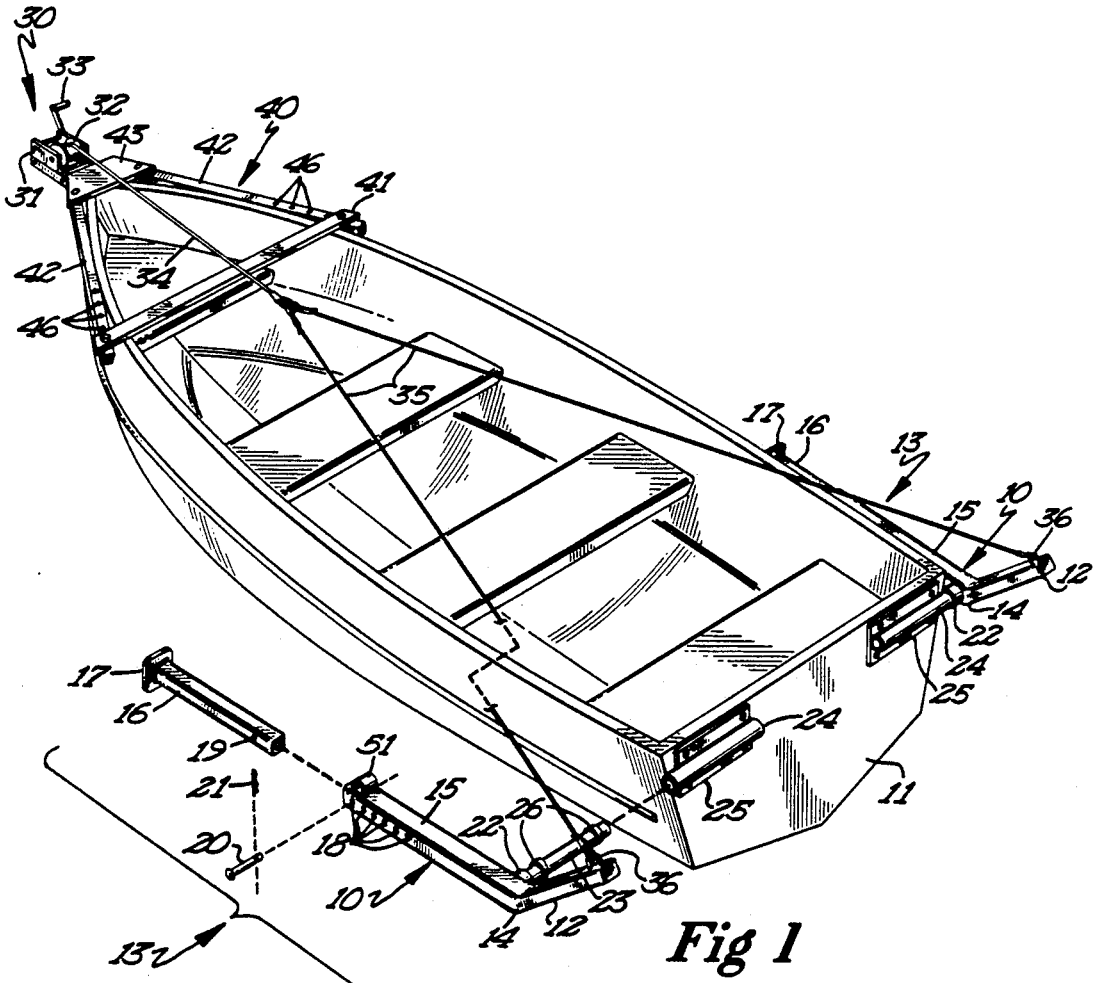
FIG. 1 is a top elevational view of a boat and a boat lift in accordance with the present invention partially exploded to illustrate the stern support connections.

The present invention provides a lift for at least the stern of a boat and includes a stern support, means for pivotally securing the support to the boat, and means for selectively pivoting the support to raise the boat to a desired level. In one preferred embodiment (illustrated in FIGS. 1, 2, 4 and 5) the stern support is formed of two members 10, one for each side of a boat 11. Each member 10 is shaped as a dogleg having a support arm 12 and a support leg 13. The arm 12 and leg 13 are angularly joined at a knee 14 in such a manner that support arm 12 extends upwardly and rearwardly from the knee 14 when the leg 13 lies at rest along the side of the boat. As illustrated, two support members 10 are provided, one at each side of the boat 11. The members 10 may be secured in the rest position of FIG. 2 in any desired manner.

In a preferred embodiment' particularly shown in FIGS. 1, 2, 4 and 6, support leg 13 includes an upper portion 15 formed as a square tube and a lower portion 16 also formed as a square tube. Lower leg portion 16 is telescopically receivable in upper leg portion 15. A square foot 17 is attached to the lower leg portion 16.

Upper leg portion 15 has a plurality of outwardly facing holes 18 while lower leg portion 16 has a similarly sized hole 19. A pin 20 inserted through the holes 18 and 19 when the leg portions 15 an 16 are in nesting relation fastens the leg portions against relative movement. A cotter pin or clip 21 secures the pin 20 in place. In this manner, support legs 13 are extensible by adjusting lower leg portion 16 within upper leg portion 13. By telescoping the leg portions 15 and 16 in this fashion, stern support 10 may be adjusted to permit varying heights of elevation.

Figure 5:
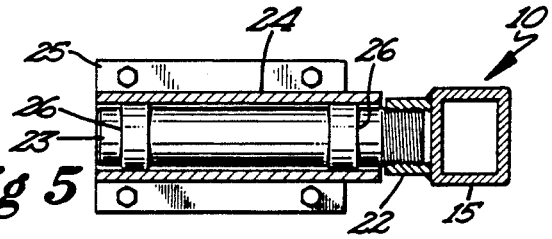
FIG. 5 is a cross section of an element of the illustrated embodiment as viewed along the line 5—5 in FIG. 2.
Figure 6:
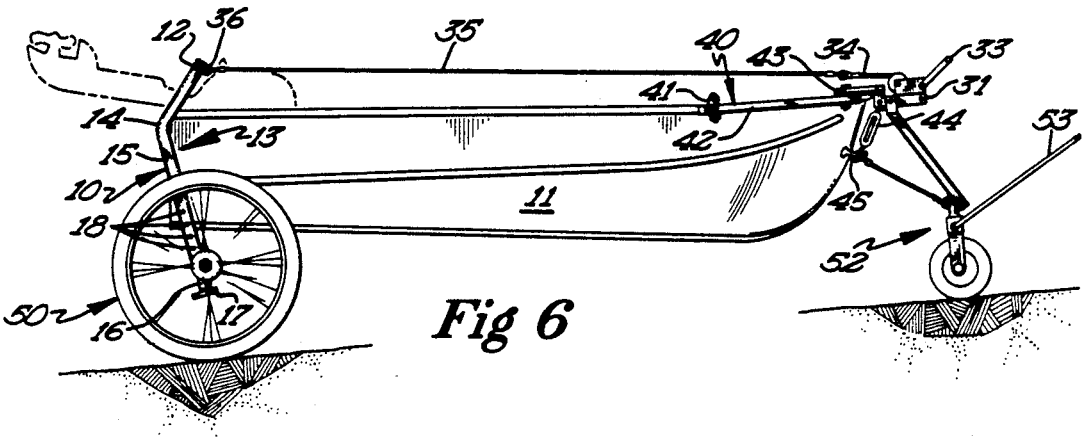
FIG. 6 is a side view of a boat/boat lift in accordance with the present invention fitted with an optional front and rear wheel assembly.

Stern support 10 is pivotally connected to boat 11. As shown in FIGS. 1 and 5, the pivot connection includes couplings 22 welded to the support members 10 at or near the knee 14 and extending inwardly (toward the boat). An axle 23 is carried by and extends from the coupling 22. Journal boxes 24 are welded to rectangular plates 25 along a length of plates 25. The axles 23 are provided with a pair of bushings 26 which cooperate with journal boxes 24 in known manner.

Rectangular plates 25 are fastened to boat 11 such that journal boxes 24 extend generally horizontally along the transom of boat 11. The axles 23 may be threadably received within couplings 22 or may be affixed in any other desired manner. As will be apparent to those familiar with the art, the axle 23/bushing 26 combinations fit loosely within journal boxes 24 to allow pivoting movement of the members 10 relative to the boat 11.

A system for selectively pivoting the stern support members 10 is illustrated in FIGS. 1, 2, 4 and 6 as a standard winch assembly 30. The assembly 30 includes mounting brackets 31, a conventional rotatable ratchet drum 32, a crank 33 and a "locking" latch (not shown). A cable set 34 (or similar flexible tension members) includes one element wound around the drum 32 with separate elements 35 extending to the support arms 12, the elements 35 being secured in any suitable manner to support arms 12. In the illustrated embodiment, cable set elements 35 are fastened to ring hooks 36 located on support arms 12.

Winch 30 is attached to boat 11 by a frame 40 having a crossbar 41 and two converging side rails 42 secured to a tongue 43. Rails 42 are readily connectable to the gunwales of boat 11, if desired. In most instances, it will be necessary only to secure the frame 40 at the bow of the boat. A convenient securement is illustrated as a turnbuckle 44 (for adjustability) attached to the bottom of winch assembly 30 and hooked to an anchor eye 45 commonly found at the bow of boat 11. Winch 30, via brackets 31, is also fastened in any suitable manner to tongue 43, as by bolts or screws. The advantage of this arrangement is that the boat lift winch assembly can be readily fastened to such a conventional boat. The side rails 42 may be provided with a series of holes 46 for adjustable securement with crossbar 41 in any desired manner.

Figure 2:
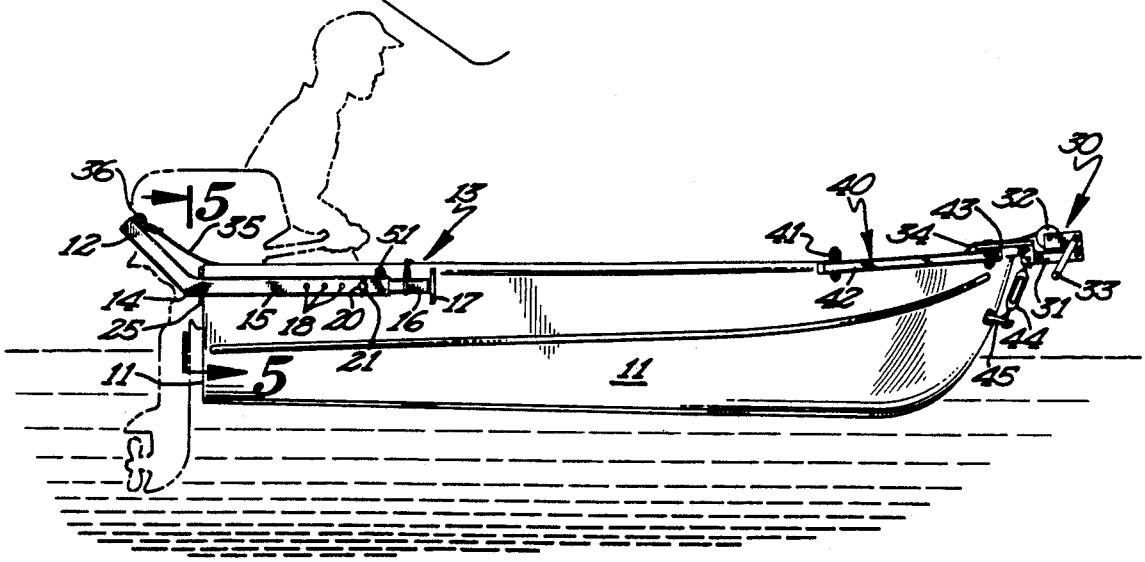
FIG. 2 illustrates a side view of the boat lift of FIG. 1 with the legs in their normal (rest) position relative to a boat to which the lift is attached.
Figure 3:
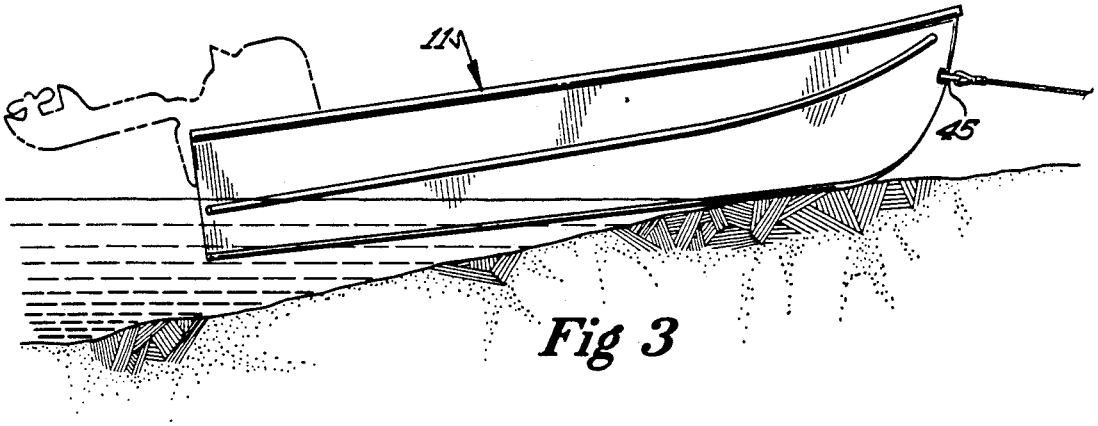
FIG. 3 is a side view of a boat with its bow at rest on the shore of a water body and the stern in a floating, unelevated relation to the water.

As shown in FIGS. 1 and 2, support legs 13 are in a raised, rest position in which support legs 13 extend along a gunnel of the boat. From this position, the support legs 13 may be lowered to an initial position from which the boat may be raised upon stern support wheels 50 (See FIG. 6) or support legs 13 with the same action. Stern support wheels 50 are conventional wheels having a circular frame, hub and spokes. Stern support wheels 24 may be carried by support legs 13 in any desired manner, as by axles engaging bearings 51 on legs 13, for example. The wheels 50 are discussed more fully below. The initial position is that position wherein the foot 17, or wheels 24—if used, lie on the water bottom or on the ground.

The raising action discussed above is established by crank 33 actuating winch 30. Ratchet drum 32 is rotated by crank 33 to wind cable set 34 thereon, in known manner. The action of winch 30, via cable set 34, simultaneously pivots support arms 12 toward the bow from the initial position to a final position whereby boat 11 is raised on wheels 50 or feet 17 of support legs 13 and elevated to a desired level relative to the ground or water bottom (See FIGS. 4 and 6). The simultaneous action of cable set 34 on each of the supports 10 serves to avoid tipping of the boat 11. Stern supports 10 are maintained in position by the locking latch of winch 30, discussed above. Conversely, the boat can be readily lowered and stern supports 10 returned to the initial position by releasing the locking latch on winch 30 and releasing cable set 34. During movement of the support arms 12 from the initial position to the final position, the boat is urged in a direction forward of the bow.

Figure 4:
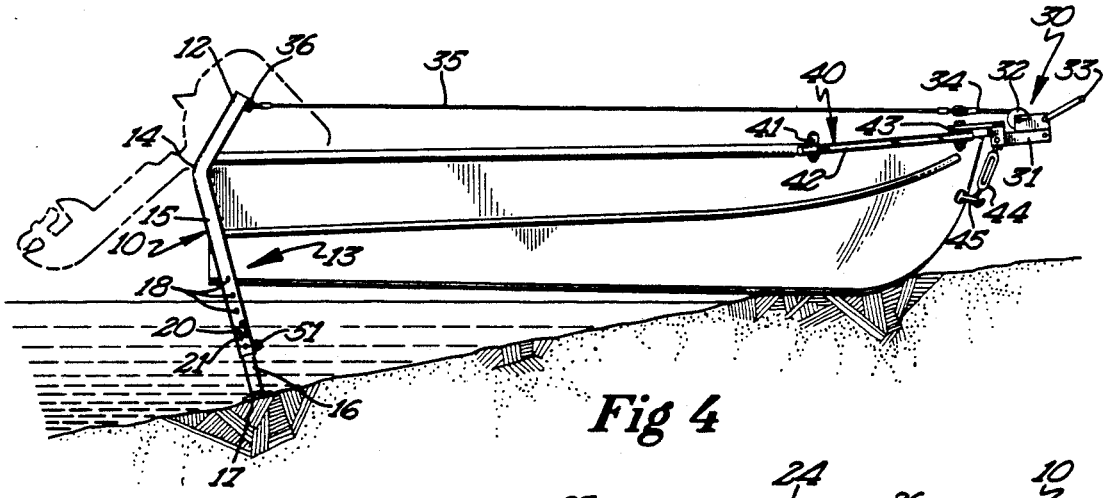
FIG. 4 is a side view of a boat/boat lift in accordance with the present invention with the boat stern in an elevated position relative to the water.

As illustrated in FIG. 4, when the support legs 13 are pivoted to the final position shown in FIG. 4, boat 11 is elevated amply to store the boat out of the water. Thus, being relatively unaffected by marine disturbances, boat 11 can be stored in the position shown in FIG. 4 for long periods of time. Support wheels 50 may ease the raising of the boat stern, depending upon the condition of the water bottom. Additionally, support wheels 50 may be used to transport the boat 11, with or without the further assistance of a bow wheel assembly 52. Bow wheel assembly 52 may include a handle 53 and be secured to the bow of boat 11 in any desired manner, as by cooperation with anchor eye 45, and winch brackets 31, as illustrated.

The boat lift of the present invention can be attached to a great variety of boats without alteration to the boats and the complete attachment can be assembled by an average boat owner using conventional tools.

Although the present invention has been described with reference to preferred embodiments, workers skilled in the art will recognize that changes can be made in form and detail without departing from the spirit and scope of the invention.

What is claimed is:

1. An attachment for a boat for raising the stern of the boat by engagement with the ground or water bottom comprising:

stern support means;

means for pivotally securing the support to the boat; and means for selectively pivoting the support between an initial position and a final position wherein the boat stern is raised relative to the water bottom, the selectively pivoting means being carried by a frame attached to the boat, said frame having a crossbar and two converging side rails secured to a tongue.

2. The attachment of claim 1 wherein the stern support means includes at least two members, each member formed as a dogleg having a support arm and a support leg.

3. The attachment of claim 2 wherein the means for selectively pivoting the support rotates the support from the initial rest position wherein the support legs are positioned substantially parallel to an upper circumferencial edge of the boat, wherein after pivoting the support legs engage the ground or water bottom, the support legs being more perpendicular to the circumferencial edge in the final position than in the initial rest position.

4. The attachment of claim 2 wherein the means for pivotally securing the stern support to the boat comprises:

a pair of journal boxes secured to the stern of the boat; and a pair of axles, each carried by a different stern support and receivable within a journal box secured to the boat stern.

5. The attachment of claim 4 wherein the journal boxes extend horizontally along the transom of the boat.

6. The attachment of claim 1 wherein the support pivoting means includes a plurality of flexible tension members extending from the support pivoting means to the stern support means.

7. An attachment for a boat for raising the stern of the boat by engagement with the ground or water bottom comprising:

stern support means comprising two members, each formed as a dogleg having a support arm and a support leg, and each support leg having an outer square tube, a telescopingly adjustable inner square tube receivable in the outer tube, and a foot attached to the inner square tube;

means for pivotally securing the support to the boat; and means for selectively pivoting the support between an initial position and a final position wherein the boat stern is raised relative to the water bottom, the selectively pivoting means being attached to the boat.

8. An attachment for a boat for raising the stern of the boat by engagement with the ground or water bottom comprising:

stern support means;

means for pivotally securing the support to the boat; and means for selectively pivoting the support between an initial position and a final position wherein the boat stern is raised relative to the water bottom, the selectively pivoting means being attached to the boat and being carried by a frame having a crossbar and two converging side rails secured to a tongue, the frame being connectable to the boat.

9. The attachment of claim 8 wherein the stern support means includes at least two members, each member formed as a dogleg having a support arm and a support leg.

10. The attachment of claim 9 wherein the means for selectively pivoting the support rotates the support from the initial rest position wherein the support legs are positioned substantially parallel to an upper circumferencial edge of the boat, wherein after pivoting the support legs engage the ground or water bottom, the support legs being more perpendicular to the circumferencial edge in the final position than in the initial rest position.

11. The attachment of claim 9 wherein the means for pivotally securing the stern support to the boat comprises:

a pair of journal boxes secured to the stern of the boat; and a pair of axles, each carried by a different stern support and receivable within a journal box secured to the boat stern.

12. The attachment of claim 11 wherein the journal boxes extend horizontally along the transom of the boat.

13. The attachment of claim 8 wherein the support pivoting means includes a plurality of flexible tension members extending from the support pivoting means to the stern support means.

14. The attachment of claim 8 wherein the stern support means comprises two members, each formed as a dogleg having a support arm and a support leg, and each support leg having an outer square tube, a telescopingly adjustable inner square tube receivable in the outer tube, and a square foot attached to the inner square tube.

15. An attachment for a boat for raising the stern of the boat by engagement with the ground or water bottom comprising:

stern support means comprising two members, each formed as a dogleg having a support arm and a support leg, and each support leg having an outer square tube, a telescopingly adjustable inner square tube receivable in the outer tube, and a square foot attached to the inner square tube;

means for pivotally securing the support to the boat; and means for selectively pivoting the support between an initial position and a final position wherein the boat stern is raised relative to the water bottom, the selectively pivoting means being attached to the boat.

16. The attachment of claim 15 wherein the means for selectively pivoting the support rotates the support from the initial rest position wherein the support legs are positioned substantially parallel to an upper circumferencial edge of the boat, wherein after pivoting the support legs engage the ground or water bottom, the support legs being more perpendicular to the circumferencial edge in the final position than in the initial rest position.

17. The attachment of claim 15 wherein the means for pivotally securing the stern support to the boat comprises:

a pair of journal boxes secured to the stern of the boat; and a pair of axles, each carried by a different stern support and receivable within a journal box secured to the boat stern.

18. The attachment of claim 15 wherein the support pivoting means includes a plurality of flexible tension members extending from the support pivoting means to the stern support means.

19. The attachment of claim 15 wherein the selectively pivoting means is carried by a frame having a crossbar and two converging side rails secured to a tongue, the frame being connectable to the boat.

20. An attachment for a boat for raising the stern of the boat and moving the boat forward by engagement with the ground or water bottom comprising:

stern support means;

means for pivotally securing the support to the boat; and means for selectively pivoting the support between an initial position and a final position, the selectively pivoting means being carried by a frame having a crossbar and two converging siderails secured to a tongue, wherein during pivoting the boat stern is raised relative to the water bottom and the boat is moved in a direction forward of the bow, the selectively pivoting means being attached to the boat.

21. The attachment of claim 20 wherein the stern support means includes at least two members, each member formed as a dogleg having a support arm and a support leg.

22. The attachment of claim 21 wherein the means for selectively pivoting the support rotates the support from the initial rest position wherein the support legs are positioned substantially parallel to an upper circumferencial edge of the boat, wherein after pivoting the support legs engage the ground or water bottom, the support legs being more perpendicular to the circumferencial edge in the final position than in the initial rest position.

23. The attachment of claim 20 wherein the means for pivotally securing the stern support to the boat comprises:

a pair of journal boxes secured to the stern of the boat; and a pair of axles, each carried by a different stern support and receivable within a journal box secured to the boat stern.

24. The attachment of claim 23 wherein the journal boxes extend horizontally along the transom of the boat.

25. The attachment of claim 20 wherein the support pivoting means includes a plurality of flexible tension members extending from the support pivoting means to the stern support means.

26. An attachment for a boat for raising the stern of the boat and moving the boat forward by engagement with the ground or water bottom comprising:

stern support means comprising two members, each formed as a dogleg having a support arm and a support leg, and each support leg having an outer square tube, a telescopingly adjustable inner square tube receivable in the outer tube, and a foot attached to the inner square tube;

means for pivotally securing the support to the boat; and means for selectively pivoting the support between an initial position and a final position, wherein during pivoting the boat stern is raised relative to the water bottom and the boat is moved in a direction forward of the bow, the selectively pivoting means being attached to the boat.

* * * * *